United States Patent [19]

Ellis et al.

[11] Patent Number: 4,458,781

[45] Date of Patent: Jul. 10, 1984

[54] CLIMBING AID AND SAFETY DESCENT DEVICE

[76] Inventors: J. Nigel Ellis, 306 Country Club Dr., Wilmington, Del. 19803; Meyer Ostrobrod, 6723 Castor Ave., Philadelphia, Pa. 19149

[21] Appl. No.: 430,244

[22] Filed: Sep. 30, 1982

[51] Int. Cl.[3] ..... A62B 1/10; A62B 35/02

[52] U.S. Cl. ..... 182/5; 182/10; 182/239; 182/234; 182/8

[58] Field of Search ..... 182/3, 5, 231–235, 182/5–8, 10, 191, 192, 241, 239

[56] References Cited

U.S. PATENT DOCUMENTS

| | | | |
|---|---|---|---|
| 511,896 | 1/1894 | Killeen | 182/8 |
| 1849725 | 3/1932 | Quick | 182/10 |
| 2,280,396 | 4/1942 | Gentry | 182/6 |
| 2,538,904 | 1/1951 | Herod | 182/8 |
| 3,467,224 | 9/1969 | Curtis | 182/191 |
| 3,826,335 | 7/1974 | Allen | 182/10 |
| 3,908,791 | 9/1975 | Kleine | 182/8 |
| 3,946,989 | 3/1976 | Tsuda | 182/241 |
| 4,111,281 | 9/1978 | Jacobs | 182/10 |
| 4,252,214 | 2/1981 | Miller | 182/8 |

FOREIGN PATENT DOCUMENTS

| | | | |
|---|---|---|---|
| 163705 | 11/1933 | Switzerland | 182/8 |

*Primary Examiner*—R. P. Machado

*Attorney, Agent, or Firm*—Russell, Georges, Breneman, Hellwege & Yee

[57] ABSTRACT

A novel controlled descent device is disclosed which not only aids in the ascent of a human being from a lower elevation to an upper elevation but also provides for the safe descent of a human being from the upper level to the lower level. The apparatus comprises a round cable, a counterweight, a controlled descent pulley having a ratchet and pawl brake system and a conventional pulley; all operating conjunctly dependently on the position and situation of the human being. The controlled descent pulley and conventional pulley are held in a plate structure which is secured to the upper elevation. The counterweight is raised and lowered from the upper elevation to the lower elevation and vice-versa by means of a guy wire which is anchored and held in relatively taught position between said upper elevation and said lower elevation.

18 Claims, 7 Drawing Figures

FIG. 4
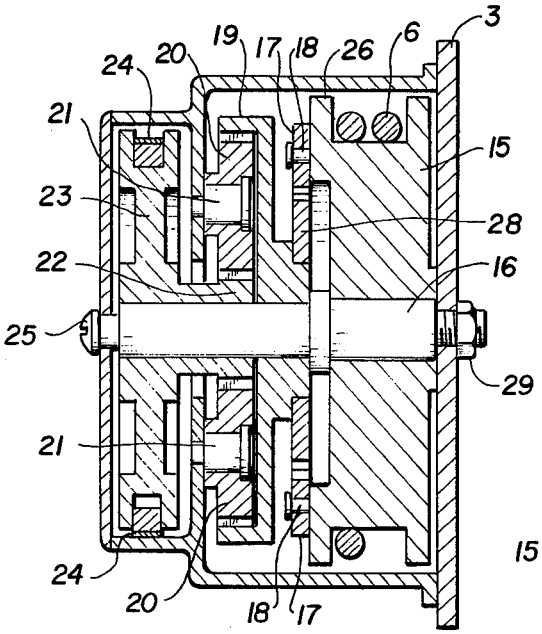
FIG. 5
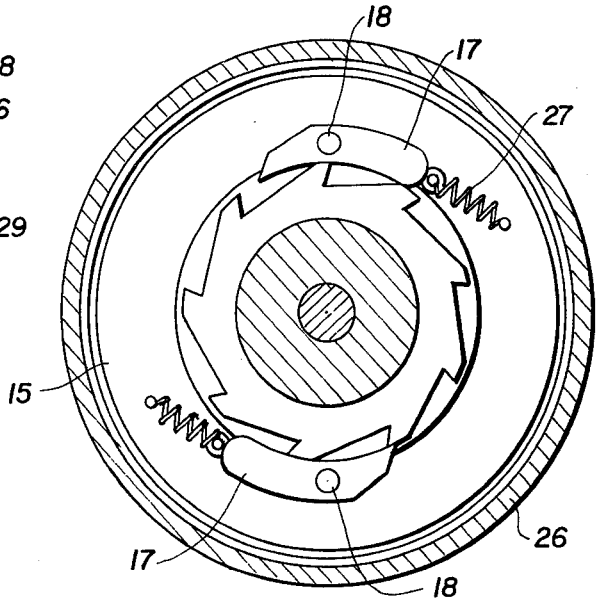
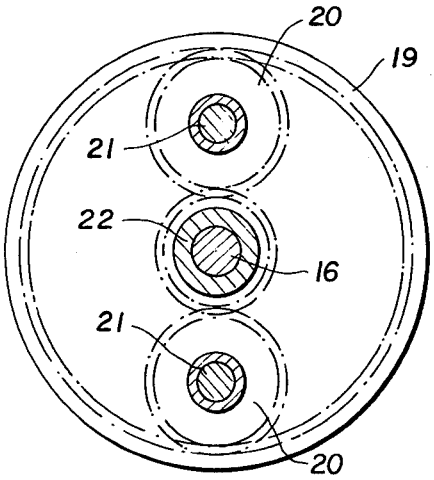
FIG. 6
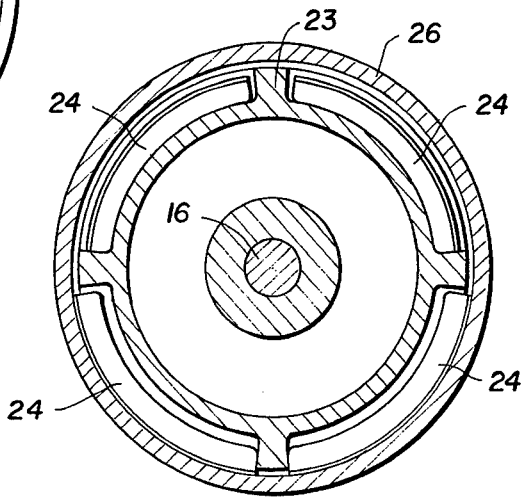
FIG. 7

CLIMBING AID AND SAFETY DESCENT DEVICE

FIELD OF INVENTION

The field of this invention pertains to a device for ascent or descent from one horizontal level to another where safety is a factor. The system is specifically designed for taller man-made structures such as oil rigs, tall buildings, water towers, monuments, billboards, rocket launching platforms, multi-layered garage parking areas, flagpoles, etc. or natural barriers such as hills, mountains, cliffs, mesas, etc. This invention may also be used for domestic in home use such as ascent and descent to hard to reach exterior areas of the home such as upper story windows, masonry wall coping, roofs, or even interior structures such as cathedral ceilings, attics, etc. The instant system combines the use of a counterbalance weight system in order to assist ascent of a human being with a controlled descent device for the constant speed descent of a human being either in case of a fall or an emergency where escape from a higher level to a lower level becomes necessary in a relatively short amount of time. The instant system may also be used in nautical environments such as ascent and descent from various portions of a ship or in an off-shore oil drilling rig for the same purpose.

Not only does the instant invention act as a fall prevention or emergency escape safety device, it also conjunctly acts to aid the ascent of a workman so that less output energy is required to raise the workman from one lower horizontal level to a second upper horizontal level. Thus, this invention should not only be viewed as a controlled descent device but also as an anti-gravity ascent device aid.

As will be further highlighted, the instant invention allows for relatively free movement of the human being even while the safety fall prevention device is attached thereto. The controlled descent in case of a fall or an emergency is made at a controlled safe speed through the instant novel braking device to permit a safe or cushioned landing onto a lower surface. The control descent device will therefore act to break the fall of an accident victim without the herky-jerky stop and start of some prior art control descent devices, which even though they may have prevented death or permanent injury to the occupant, nevertheless caused other medical problems such as whiplash, back pull, broken legs, broken arms, stiff necks, etc. Other aspects of this controlled descent and ascent aide will be further described hereinafter in regard to the attached drawings representative of this invention.

PRIOR ART

Candor compels a recognition of prior art. Generally, such devices are normally classified in Class 182, various subclasses, i.e., 231, 3, 234, 5, 191, 8 and 10.

One patent within said Class 182, was issued to Quick in 1932 concerning an oil well derrick escape device wherein a pulley and counterweight transverse a hold down guy wire and are attached to a trolley that is likewise mounted to transverse an opposing guy wire. The latter, through snaphooks, belt and cable is attached to an oil derrick workman. A second pulley set and auxiliary counterweight is situated in interconnection with the aforementioned trolley. In use, the weight of the workman overcomes the first counterweight allowing passage of the trolley down the opposing guy wire. During traversal, the second set of pulleys and auxiliary counterweight augment the weight on the opposing guy wire thereby gradually slowing descent. This system is dependent upon the relationship of the worker's weight, auxiliary weight and counterweight. Also, the angles of criticality must always be changed as the worker attains a higher level on the platform.

Approximately 37 years later another U.S. Pat. No. 3,467,224, was issued to Curtis et al which disclosed a cable safety clamping device (fluid actuated) for snubbing and retaining cables which have snapped as a result of overuse etc. in an oil well drilling operation. In this way a broken cable will not be lost via passage down inside an oil well. Activation occurs either by electrical switch means responsive to the whipping action of a slack cable or by manual energization of the switch means. In either event, the gripping wedges are fluid pressure servo actuated and situated opposite one another about the cable.

In 1974 a personnel-load carrying system was patented by Allen, U.S. Pat. No. 3,826,335, wherein the means of descent is adapted for quick descent down and away from the work area in contradistinction to alongside the work area. Succinctly, a three way valve system (hydraulic air system) is used as a fluid power means for movement of a gondola relative to an interconnected counterweight. The passage of said gondola along the carrying line, which is at a relatively acute angle with the derrick, is slowed via a friction braking system. The latter comprises a friction plate and brake table with attached means to compress the former against the latter in the event of a slackening of the cable.

A safety clamp is described in Kleine et al's U.S. Pat. No. 3,908,791 (1975), to protect a workman from falling from high environments. The clamp is situated vertically along a safety member (i.e. cable) placed parallel to the length of a ladder. The cable is held in place via top and bottom cable anchor possessing means for small adjustment. A permanent gripping clamp is attached to the safety belt and cable so that in case of a fall the weight of the workman applies a downward force vector on the interconnecting arm which induces a compressional and fractional grip on the cable. In this manner, the fall is halted and the workman can regain his balance or at least await rescue.

A ratchet and pawl braking system is provided for a workman in Paulie, U.S. Pat. No. 4,130,176 (1978) wherein a cable provides ancillary protection against a fall from a building. In the event of the latter, the above braking system stops the fall below sill level. The workman can then manually rewind the cable via a crank to reattain his work position or enter through an appropriate orifice in the building.

Among other examples of slow descending mechanical braking devices is U.S. Pat. No. 3,946,989.

Recently, U.S. Pat. No. 4,252,214 (1981) issued to Miller, which concerned a fall prevention safety device for attachment to a workman's harness in order to provide a safe and controlled descent rate from an elevated position for the workman. A double pulley-hydraulic cylinder system is provided whereby an upper pulley is attached to the elevated structure while a lower pulley is mounted to the upper portion of a vertically situated reciprocal plunger, which falls into the hydraulic cylinder. The plunger's upward movement is resisted by the hydraulics of the cylinder but not the downward movement of the same. Thus, the plunger and lower pulley provide a constant tension in the cable during ascent. In case of a fall, a control valve determines how fast the hydraulic fluid may escape and thereby the upward velocity of the plunger's withdrawal. A fortiori, the descent rate becomes a function of the quantity of hydraulic fluid and thereby the rate of descent is controlled by means of a control valve opening.

OBJECTS AND EMBODIMENTS

It is therefore an object of this invention to provide a safe control descent device for a workman.

A further object of this invention is to provide a simple counterweight braking device which will act not only as a control descent device but also as an aid to a climber in an ascent to an upper level.

A further object of this invention resides in a controlled descent device wherein the counterweight need not be equal to the weight of the worker and yet be full-proof against the workers harmful fall in an emergency. Even though this is a specific embodiment of this invention, the apparatus described herein is of a relatively simple nature, which can be modified in order to increase or decrease the counterweight system in compliance with OSHA Program Directive 100-103 wherein the counterweight must be equal to the weight of the worker.

One embodiment of this invention resides in a controlled descent device for a human being to safely descend from an upper level of elevation to a lower level of elevation which comprises a first connection means for connecting a round main cable with a safety belt attached to said human being; a round main cable for interconnection of said first connection means with a counterweight means; a second connection means for connecting said round main cable to said counterweight means; a counterweight means; a round guy cable held relatively taught and attached to said upper and a lower elevation; a first pulley means interconnecting said counterweight means and said round guy cable wherein as the first pulley means transverses said guy cable the counterweight moves in the same direction parallel to said round guy cable means; a second pulley means for transversal of said round main cable; a controlled descent pulley device for passage of said round main cable once therearound wherein said second pulley means and said controlled descent pulley device are supported by a structure of said upper elevation and wherein said round main cable will lower said human being at a controlled rate of descent to said lower elevation by a brake means comprising a brake shoe and a cover wherein the spin of said pulley is decreased by friction of said brake shoe upon said cover; and wherein said brake shoe is activated by the applied weight of said human being to a ratchet and pawl brake means.

A specific embodiment of this invention resides in an apparatus for a human being to safely descend from an upper elevation to a lower elevation and to aid in the upward motion from the lower elevation to the upper elevation which comprises a round main cable in interconnection with a counterweight and the human being; a guy cable and counterweight pulley means for movement of said counterweight in a direction opposite to that of the movement of the human being; a pulley means for passage of the round main cable intermediate the counterweight and the human being; a controlled descent pulley means having a ratchet and pawl centrifugal force activating brake means for both intermittent passage of the round main cable around said control descent pulley means when said human being is moving in the same direction as the pull of gravity and; continuous transversal of the round main cable around said control descent pulley means when said human being is moving in a direction opposite to that of gravitational pull.

Yet another specific embodiment of this invention resides in a controlled descent and ascent aid device which cdmprises an apparatus to provide aid in the ascension from a lower elevation to an upper elevation of a human being which comprises a counterweight means in interconnection with a human being by a main round cable wherein said cable transverses a controlled descent pulley and a second pulley in a continuous manner to provide an even ascension from said lower elevation to said upper elevation.

SUMMARY OF THE INVENTION

The invention depicted in the instant drawings can be summarized as a counterweight system for the controlled descent of a worker while also permitting or aiding the ascent of a worker vis-a-vis less exertion. The device utilizes a wire rope such as a 3/16" non-rotating galvanized steel cable upon which rollers attached to the counterweight transverse the cable in relation to the elevation of the worker. At the other end of the galvanized cable is an attachment means such as a swag sleeve and thimble for attachment to a swivel of the safety belt mechanism. This swivel may also be in interconnection with a rung hook of a ladder which parallels the ascent directive of the worker. The instant device has many advantages over safety devices now in use.

For example, one such advantage is that the device may be taken off the cable which allows for work on different levels with but one device. In other words, the device is portable with the worker. Another advantage is the easy maintenance and removal of extrinsic or undesirable foreign material which may collect on the rotating galvanized cable or in the controlled descent device pulley system hereinafter described. Yet another advantage of this invention is the fact that when the same is used in an adverse environment it may be removed relatively easily and stored so as not to be attacked by such chemicals as brine or seawater while not in use.

The use of this invention is relatively simple on the behalf of the workman. While any system must be attached properly in order to work, this system once so attached can be utilized in any environment. That is, when the temperature is very cold it does not necessitate a nimble finger or a sophisticated snap-in lock in order to attach the same to the workman safety belt. The instant device can easily be utilized with coverings upon the hand. This will not only eliminate some electrical hazards but will also increase workers safety as a result of cold or exposure to the upper extremities. If the wheels attached to the counterweight are of sufficient size, many different types of cables can be utilized. Thus, not only can a non-rotating galvanized 3/16" cable be utilized but also any other type of cable including nylon or aramide fibers ranging from 1/16" of an inch to 2" in diameter. While it is not contemplated to utilize this system for the ascent or descent of working materials, the same still could be used if the proper snaps were applied to the swagged sleeve and thimble at the alternative end of the cable from the counterweight system. Again, this is not the primary use of the instant apparatus. But during emergencies, or as desired, the means of raising and lowering a critical heavy item can be varied to include this concept and apparatus.

The instant control descent device pulley system will function so as to eventually lower a worker to the ground at a constant rate of speed of 4 to 6 feet per second. This is in contrast to some older prior art systems which either leave the workmen dangling in air or require some type of ratchet system for him to reattain the elevated position from which he fell. The instant device not only provides for the controlled descent of a workman to the ground but also aids him in ascending to an elevated platform. It can be seen from the instant drawing that the counterweight actually acts to pull the worker up from one level to the next while not being of such a weight as to overpower the worker and thus accelerate his elevation at an unsafe speed.

GENERAL DESCRIPTIONS OF THE DRAWINGS

FIG. 4 is a section view of the pulley control descent device taken on the line B—B of FIG. 1.

FIGS. 5, 6 and 7 are cut-away views of the pulley control descent device of FIG. 4.

Figures 1, 2, 3:
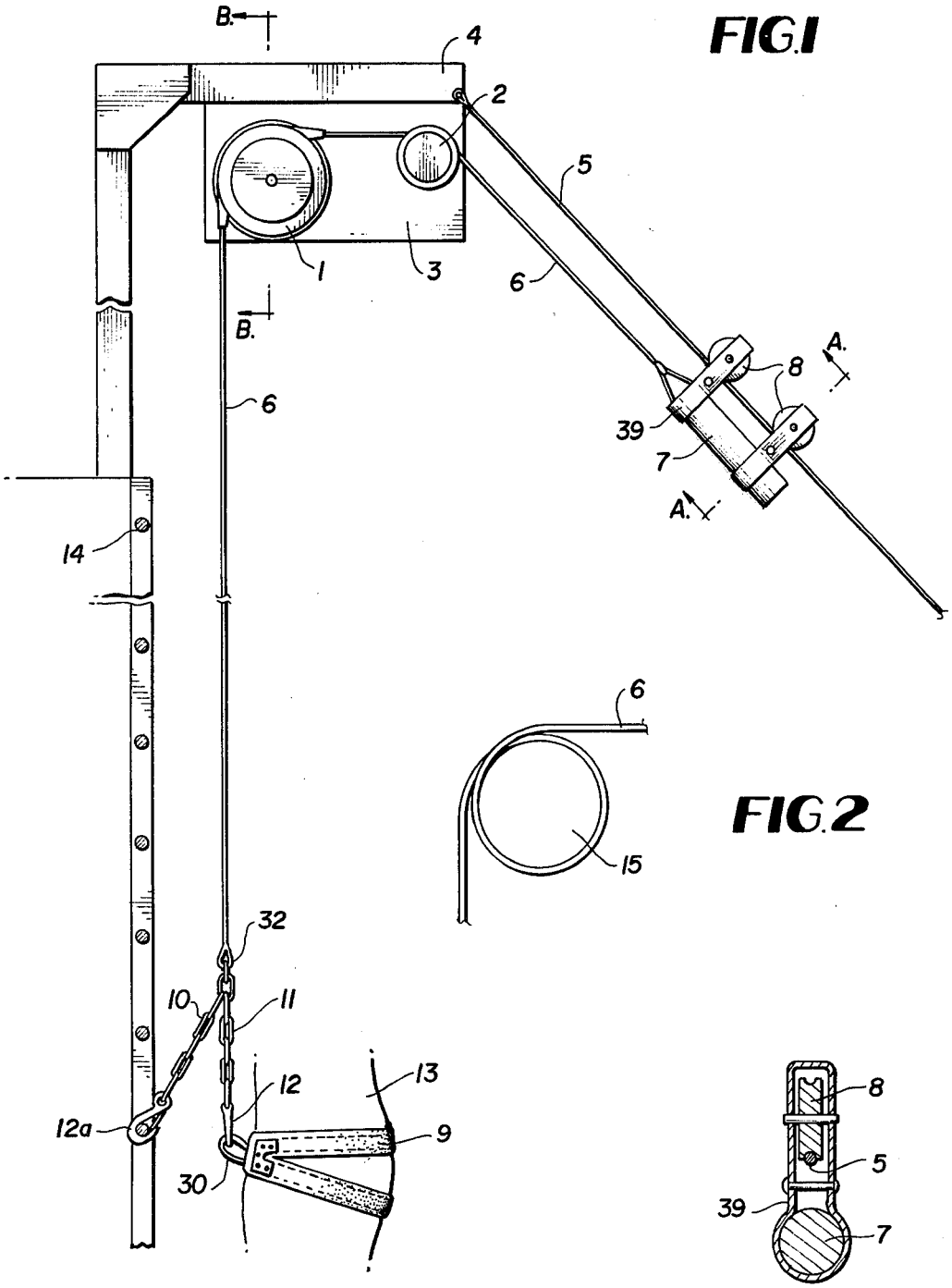
FIG. 1 is a side view of the counterweight system for controlled ascent and descent from one elevation to another.
FIG. 2 is a side view of pulley 15.
FIG. 3 is a section view taken on the line A—A of FIG. 1.

FIGS. 1 through 7 comprise the following parts: pulley controlled descent device 1; pulley 2; plate 3; support 4; guy cable 5; main cable 6; counterweight 7; counterweight wheels 8; safety belt 9; ladder anchoring chain 10; safety belt attachment chain 11; snap hooks 12, 12*a*; worker 13; ladder 14; pulley 15 on controlled descent device; center shaft 16; brake pawls 17; brake pawl pins 18; crown wheel 19; idler gear 20; stud 21; center gear 22; brake holder 23; brake shoe 24; center bolt 25; cover 26; brake pawl spring 27; and, ratchet wheel 28. A further detailed discussion of the drawings follows.

DETAILED DISCUSSION OF THE DRAWINGS

FIG. 1 shows a workman 13 whose injury is to be prevented by the overall operation of the device and whose ascent of ladder 14 is likewise aided by the system. The ladder 14 is placed on a structure such as an oil rig, tall building, etc. and is firmly attached at the top or top and bottom via support structure 4. The workman 13 is connected or wearing a safety belt (9) having an eyelet 30 for reception of snap hook 12. A chain or safety belt attachment chain (11) interconnects snap hook 12 with cable thimble 32. And thimble 32 interconnects safety attachment chain 11 with main cable 6. Interconnection is also made between the ladder (on a rung of the same) 14 and main cable 6 via snap hood 12*a*, ladder anchoring chain 10 and thimble 32. The main cable is disposed in a first direction substantially parallel to the ladder 14 and the structure to be ascended until it transverses pulley control descent system 37.

The latter is comprised of holding plates 3, which may be held together by a weld, bolts, rivets, wingnuts, or any other means of permanent attachment. Between the plates are disposed a pulley 2 and a control descent pulley 1, which is further and more specifically described in FIGS. 4 through 7. The main cable is looped one time around pulley 1 and rests on or transverses over pulley 2.

Emanating from the pulley control descent system is main cable 6 which is connected via conventional anchoring means to counterweight 7. The counterweight should be designed for the weight of the ordinary or average worker 110–130 lbs. but it need not be equal to his weight. Straps 39 attach counterweight 7 to counterweight wheels 8 which transverse guy cable 5. The latter is held together in attachment with the ground or a lower elevation structure and in interconnection with a point on the support structure 4.

HOW TO ATTACH UNDER NORMAL WORKING CONDITIONS

The attachment of the worker (13) to the controlled descent device is as follows: when not in use, the ladder anchoring chain (10) is attached to a rung near the bottom of the ladder (14) by a snap hook (12*a*). The worker (13) must first attach the free chain (11) to his belt before disengaging the other chain (10) from the ladder (14) via snap hook (12*a*). When the worker (13) is finished climbing, he must first attach the ladder anchoring chain (10) to a rung on the ladder (14) before disengaging the safety belt attachment chain (11) from his safety belt (9) via snap hook (12) and belt eyelet (30).

OPERATION UNDER NORMAL CONDITIONS

The system is designed to assist workers in climbing tall ladders. The system reduces the worker's weight as he/she climbs upwardly via the use of a pulley and weight system (FIG. 1). The main cable (6) is attached to the worker (13) on one end and the counterweight (7) on the other end. The main cable (6) is looped (FIG. 2) once around controlled descent pulley (1) and also rides on the pulley (2). The counterweight (7) is attached to a guy cable (5) by the counterweight wheels (8). The other end of the main cable (6) is attached to two chains (10,11). The safety belt attachment chain (11) is attached to the worker's safety belt (9) by a snap hook (12). The counterweight (7) acts as an anti-gravitational force thus reducing worker fatigue. It can readily be seen that the counterweight acts as an upward pulling device to aid in the climbing of ladder 14. The controlled descent device is only engaged in emergency conditions and will be explained latter in regard to FIGS. 4 through 7 below.

FIG. 2 shows main cable 6 wrapped once around the pulley control descent device 1. FIG. 3 shows the counterweight 7, connecting straps 39, counterweight wheels 8 and guy cable 5. As the worker ascends the ladder 14, the wheels 8 permit the counterweight 7 to be lowered. Alternatively, when emergency conditions warrant quick escape from an upper elevation, the counterweight 7 moves toward support structure 4 at a rate approximately equal to rate of descent of the worker. At rest, counterweight 7 is at its uppermost elevation. Awaiting emergency use the counterweight is usually at its lowermost or a lower position of elevation.

The side view of the pulley control descent device 1 shows the interworkings of the same. A pulley 15 rotates upon center shaft 16. Upon the pulley are two brake pawls 17 which pivot around brake pawl pins 18. As shown in FIG. 5, one end of brake pawl 17 is machined to engage ratchet wheel 28 while the other extremity is attached to pulley 15 via brake pawl spring 27. A crown wheel (19) is situated on shaft 16. The ratchet wheel 28 is positioned on one side of crown wheel. On the other side of the crown wheel is positioned an idler gear 20 which has teeth that mesh with the teeth of the crown wheel 19. Idler gear 20 is held in place via stud 21. See FIG. 6. A cover 26 is attached to the stud 21. As more clearly seen in FIG. 6 a center gear 22 rides on the center shaft 16 and is attached to brake holder 23. FIG. 7 shows that there are spaces, albiet small, between by friction of the brake shoe against the cover. A center bolt 25 is used to couple with center bolt nut 29 to secure at least one and probably two plates 3.

As will readily be appreciated the rope pulley 15 is not permanently attached to the braking apparatus. The pulley rotates freely on the shaft 16. A cable goes around the pulley; one end going to the counterweight while the other end is connected to the rigger's belt. Such arrangement provides free operation in two directions with counterweight aided ascent assistance. Controlled descent is automatically provided in emergency conditions. This is accomplished through a centrifugal system of pawl and ratchet actuated brakes.

OPERATION UNDER EMERGENCY CONDITIONS

When a worker (13) falls, the centrifugal force of the spinning pulley (15) causes the brake pawls (17) to pivot against their springs (27) and thus lock into the teeth of the ratchet wheel (28). The ratchet wheel (28) is attached to the crown wheel (19). The teeth of the crown wheel (19) mesh with those of the idler gear (20) which mesh with the teeth of the center gear (22) which is attached to the brake holder (23). Thus the rotation of the pulley (15) in an emergency situation is transmitted from the ratchet wheel (28) to the crown gear (19) to the idler gear (20) to the center gear (22) and finally to the brake holder (23). The centrifugal force of the spinning brake holder (23) will cause the brake shoes (24) to come in contact with the cover of the device (26). The friction between the brake shoes (24) and the cover (26) will reduce the descent speed of the worker (13) to an acceptable speed from a safety viewpoint.

The above drawings are only representative of the various mechanical means that can be employed to provide controlled descent and enchanced ascent for a workman. And relatively equivalent mechanical means can be interchanged for one another without modifying the general parameters of the concept of this invention.

I claim as my invention:

1. A controlled descent device for a human being to safely descend from an upper level of elevation to a lower level of elevation which comprises:

(a) a first connection means for connecting a round main cable with a safety belt attached to said human being;

(b) a round main cable for interconnection of said first connection means with a counterweight means;

(c) a second connection means for connecting said round main cable to said counterweight means;

(d) a counterweight means;

(e) a round guy cable held relatively taught and attached to said upper and a lower elevation;

(f) a first pulley means interconnecting said counterweight means and said round guy cable wherein as the first pulley means transverses said guy cable the counterweight moves in the same direction substantially parallel to said round guy cable means;

(g) a second pulley means for transversal of said round main cable;

(h) a controlled descent pulley for passage of said round main cable once therearound wherein said second pulley means and said controlled descent pulley device are supported by a structure of said upper elevation and wherein said round main cable will lower said human being at a controlled rate of descent to said lower elevation by a brake means comprising:

(i) a brake shoe and a cover wherein the spin of said pulley is decreased by friction of said brake shoe upon said cover; and wherein (ii) said brake shoe is activated by the applied weight of said human being to a ratchet and pawl brake means.

2. The device for obtention of controlled descent set forth in claim 1 wherein said first connection means is adapted for interconnection with a static structure intermediate said lower and upper levels or at said upper level in addition to connection with said human beings.

3. The apparatus according to claim 1, wherein said first connection means comprises a safety belt in attachment with said human being, an eyelet in attachment with said safety belt, an elongated interconnecting third connection means, a snap for interconnecting said third connection means with said eyelet and a swagger for interconnection of said third connection means with said round main cable.

4. The apparatus according to claim 2, wherein first connection means in interconnection with said static structure is a snap hook, a swagger and a elongated interconnection fourth connection means.

5. The apparatus according to claim 1, wherein said round cable means comprises a galvanized round cable.

6. The apparatus according to claim 1, wherein said second connection means comprises at least a hook for securement to said counterweight means.

7. The apparatus according to claim 1, wherein said counterweight means are masonry items weighing less than, more than or equal to said weight of said human being.

8. The apparatus according to claim 1, wherein said ratchet and pawl brake means is activated by the centrifugal force of the downward weight of said human being as a fall is occurring.

9. A controlled descent and aid in ascent apparatus for a human being to safely descend from an upper elevation to a lower elevation and to aid in the upward motion from the lower elevation to the upper elevation which comprises:

(a) a round main cable in interconnection with a counterweight and the human being;

(b) a guy cable and counterweight pulley means for movement of said counterweight in a direction opposite to that of the movement of the human being;

(c) a pulley means for passage of the round main cable intermediate the counterweight and the human being;

(d) a controlled descent pulley means having a ratchet and pawl centrifugal force activating brake means for both (i) passage of the round main cable around said control descent pulley means at a controlled rate of descent when said human being is moving in the same direction as the pull of gravity, and;

(ii) continuous transversal of the round main cable around said control descent pulley means when said human being is moving in a direction opposite to that of gravitational pull.

10. The apparatus of claim 9, wherein said control descent pulley and pulley means are located within a plate structure which is an interconnection with and supported by a first structure at the upper elevation.

11. The apparatus of claim 8, wherein the guy cable is held at a relatively taught position by interconnection with a point at the upper elevation and a point lower thereto.

12. The apparatus of claim 10, wherein said round cable is connected to said human being via a safety belt with an eyelet in the front of it for reception of a snap hook held at the end of the round cable.

13. The apparatus of claim 8, wherein said round main cable is attached to a static structure intermittent with the upper and lower level or at a position at the upper elevation.

14. The apparatus of claim 8, wherein said control descent pulley comprises a pulley having a ratchet wheel and a brake pawl pin, wherein said brake pawl pin is machined to engage intermittently the ratchet wheel and is attached to said pulley by a brake pawl spring.

15. The apparatus of claim 14, wherein said brake pawl pin intermittently engages the ratchet wheel as a result of the crown wheel and idler gear both of which have teeth meshing together.

16. The apparatus of claim 8, wherein said ratchet and pawl brake means comprises a brake shoe intermittently compressed against a cover of the controlled descent pulley to thereby provide intermittent rotation of the same around a center shaft and thereby a controlled descent of the said human being.

17. The apparatus of claim 8, wherein said human being's ascension from the lower level to the upper level is aided by the pull of said counterweight via the main round cable around the control descent pulley without engagement of the ratchet and pawl brake means.

18. An apparatus for assisting a human being to climb up a vertically oriented ladder and for slowing said human being's fall in the event of emergency descent, said apparatus comprising a counterweight, connection means for connecting a round main cable with said human being, a round cable for connecting said counterweight to said connection means, a pulley situated between said connection means and said counterweight and a centrifugal force activated controlled descent pulley means situated between said pulley and said connection means, said pulley and said centrifugal force activated controlled descent pulley being affixed to a plate supported above said human being, said cable passing upwardly from said counterweight over said pulley and then substantially horizontally from said pulley to said centrifugal force activated controlled descent pulley means, said cable thereafter being passed downwardly from said centrifugal force activated controlled descent pulley in a direction substantially parallel to the ladder.

* * * * *